US005181378A

United States Patent [19]

Devine, Jr.

[11] Patent Number: 5,181,378

[45] Date of Patent: Jan. 26, 1993

[54] VAPOR GENERATOR APPARATUS FOR POWERING A MOTOR

[76] Inventor: John A. Devine, Jr., 453 Quan, St. Louis, Mo. 63122

[21] Appl. No.: 701,091

[22] Filed: May 16, 1991

[51] Int. Cl.[5] ..... F02C 7/00

[52] U.S. Cl. ..... 60/39.55; 60/692; 60/669

[58] Field of Search ..... 60/39.55, 690, 692

[56] References Cited

U.S. PATENT DOCUMENTS 3,854,283 12/1974 Stirling ..... 60/39.55

4,680,927 7/1987 Cheng ..... 60/39.55

FOREIGN PATENT DOCUMENTS 161644 4/1921 United Kingdom ..... 60/39.55

*Primary Examiner*—Allen M. Ostrager

*Attorney, Agent, or Firm*—Polster, Lieder, Woodruff & Lucchesi

[57] ABSTRACT

A vapor generating system for supplying vapor energy to power a motor and employing the energy in the vapor exhausted by the motor to operate an air pump for supplying air to mix with a source of fuel in a combustion space in a chamber which collects vapor under pressure for release through a transmission connected to the motor. The vapor exhausted from the motor is delivered to a condenser where it resumes a liquid so the resulting liquid is able to be reused for maintaining a supply of vapor energy.

2 Claims, 4 Drawing Sheets

VAPOR GENERATOR APPARATUS FOR POWERING A MOTOR

BACKGROUND OF THE INVENTION

1. Field of the Invention

This invention is concerned with vapor generator apparatus for the efficient use of a fuel for generating a source of power to operate a motor.

2. Description of the Prior Art

It is known to provide a vapor generator using a fuel and air mixture that is combusted in the direct presence of feed water to produce a useful mixture of steam and non-condensibles. Systems of this character are known to be dangerous due to incomplete combustion, or due to the occurance of explosions.

It is also known to operate a gas turbine combustor using water vapor injection to control nitrogen oxides. Furthermore, it is known to employ a combustion chamber and water vaporization combination to cool the combustion chamber by a surrounding water circulating jacket.

The prior art has been involved with expensive apparatus of an inefficient type so that little commercial utility has resulted.

SUMMARY OF THE INVENTION

The invention hereinafter described exhibits a unique and efficent use of a wide variety of fuels for the generation of vapor to be applied as a source of power followed by the recapture of thermal energy that is usually wasted.

It is an object to generate a vapor under pressure which is passed through a supply line to drive a motor and to return the vapor in its exhausted state at a lower pressure to a condensing chamber where the vapor is converted to its liquid form for reuse as a mist to form more vapor.

Other objects include condensing waste vapor to liquid for liquid conservation, operating a vapor generation system with low pollution emissions, enabling use of liquid fuel power in an efficient vapor generation system, enabling the creation of a vapor capable of stop-start requirements in connection with its use to power motor means in a system with low noise emission

DESCRIPTION OF THE EMBODIMENT

The preferred features of the invention are seen in the several views wherein.

DETAILED DESCRIPTION OF THE PREFERRED EMBODIMENT

Figure 1:
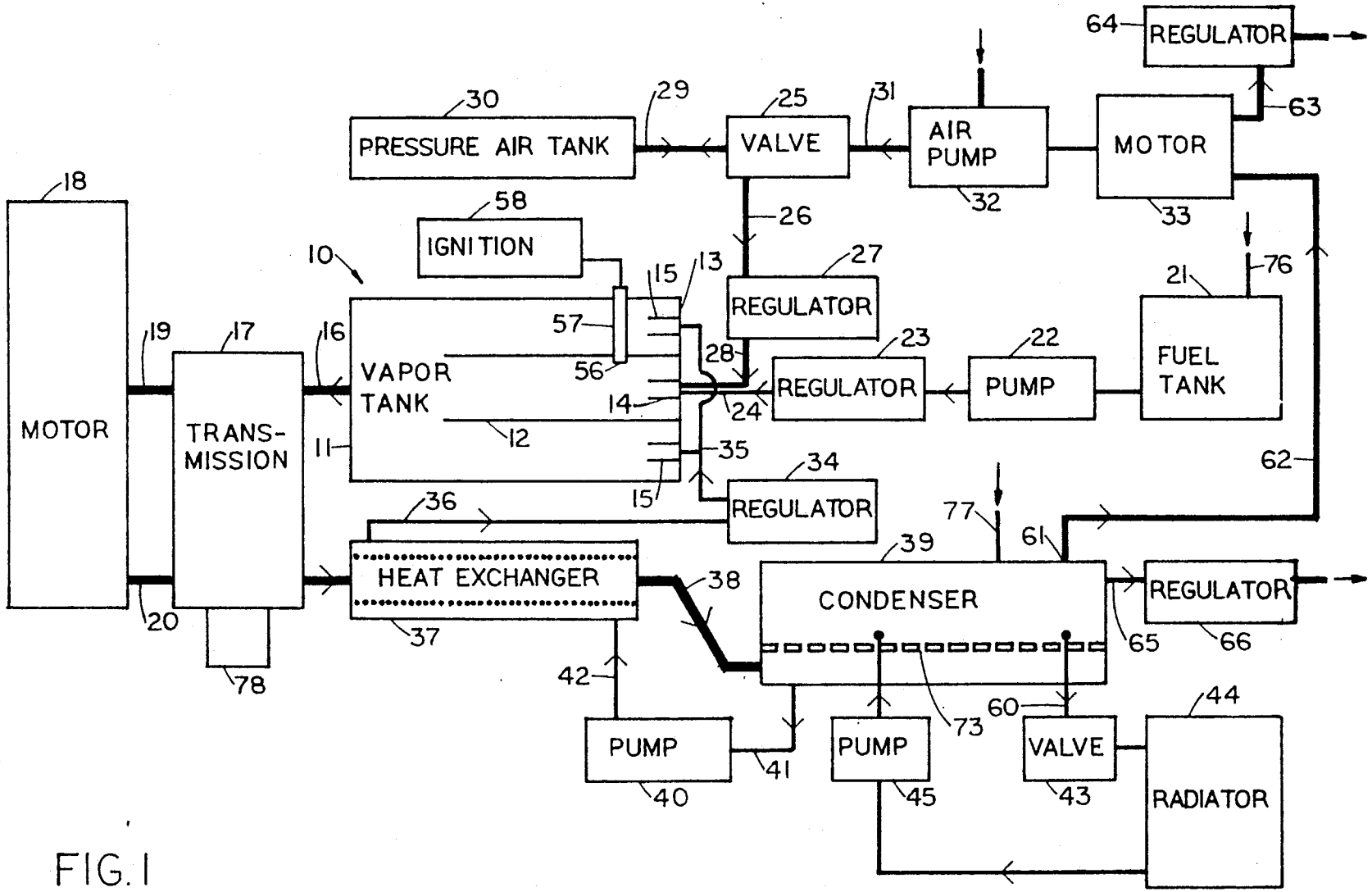
FIG. 1 is a block diagram of the several components composing the vapor generating system herein.

Referring to FIG. 1, there is shown in diagramatic form of a preferred vapor generator apparatus for creating a source of energy for powering a motor to operate a variety of systems requiring a motor as the prime mover. Central to the system is combustion means 10 which is in the form of a chamber 11 in which a vapor under pressure is generated. The chamber 11 houses a flame tube as the combustion space 12 carried by a base wall 13 of the chamber 11. A burner 14 is mounted on the base wall 13 in position to direct the flame of combustion toward the open end of the space 12. During combustion in the space 12, the confining wall and combustion exhaust is heated to a temperature that is capable of converting a liquid in a mist form into a vapor. To accomplish this, the base wall 13 carries a plurality of liquid injectors 15 which direct the liquid in mist form into the heated combustion occuring in the space 11. The thus generated vapor exists at a high pressure that is conducted by a suitable conduit 16 into a transmission device 17 associated with motor means 18 for controlling the direction of drive of the motor means 18 or its idling condition. The motor means 18 receives the vapor from inlet means 19 and exhausts the vapor at outlet 20 when the transmission supplies the motor in the forward direction.

The combustion means 10 in FIG. 1 is supplied from the burner 14 with a source of fuel 21 which is moved by pump means 22 into a fuel flow regulator 23 connected by conduit 24 into the burner 14 at a higher pressure than the pressure in chamber 12. The source of combustion air is delivered by valve 25 through conduit 26 to an air regulator 27 connected by conduit 28 into the burner 14 also at the higher pressure than that in chamber 12. The air supply from conduit 29 may be from a storage tank 30 or from conduit 31 directly from the delivery pump 32 operated by motor means 33. Valve 25 is controllable to supply the storage tank 30 to maintain it at the desired pressure level directly from the pump 32 by intercommunicating the pump 32 and tank 30 through conduits 31 and 29.

The source of the liquid for the injectors 15 is by the provison of a supply regulator 34 in conduit 35 which has suitable branches connected to each injector 15. The regulator 34 receives the liquid from conduit 36 which is the outlet from a liquid preheater device 37 inserted in the conduit 38 which is the supply for a condenser unit 39. The latter unit 39 receives the exhaust vapor discharged from motor means 18 at conduit 20. That exhaust vapor has a heat value that is made available at the preheat device 37 for elevating the temperature of the liquid condensate moved in conduit 36 from a liquid pump 40 connected to the condenser unit 39 at inlet 41. The pump outlet 42 is connected into the preheat device 37 to develop a pressure in conduit 36 so that delivery of the liquid to the injectors 15 will be at a higher pressure than the pressure in the chamber 11.

As shown in FIG. 1, the condenser unit 39 is operated to convert the exhaust vapor from the motor means at conduit 20 back to a liquid, and to separate out combustion exhaust vapor. This is accomplished by traversing that vapor through the lower temperature of the contained liquid under pressure. This contained liquid is cooled by flowing through a control valve 43 to an air cooled radiator 44 and back to the condenser unit 39 by pump means 45 in the flow system shown. Valve 43 can close off conduit 60 to allow the pump 45 to pull liquid condensate which can accumulate in the radiator.

Figure 2:
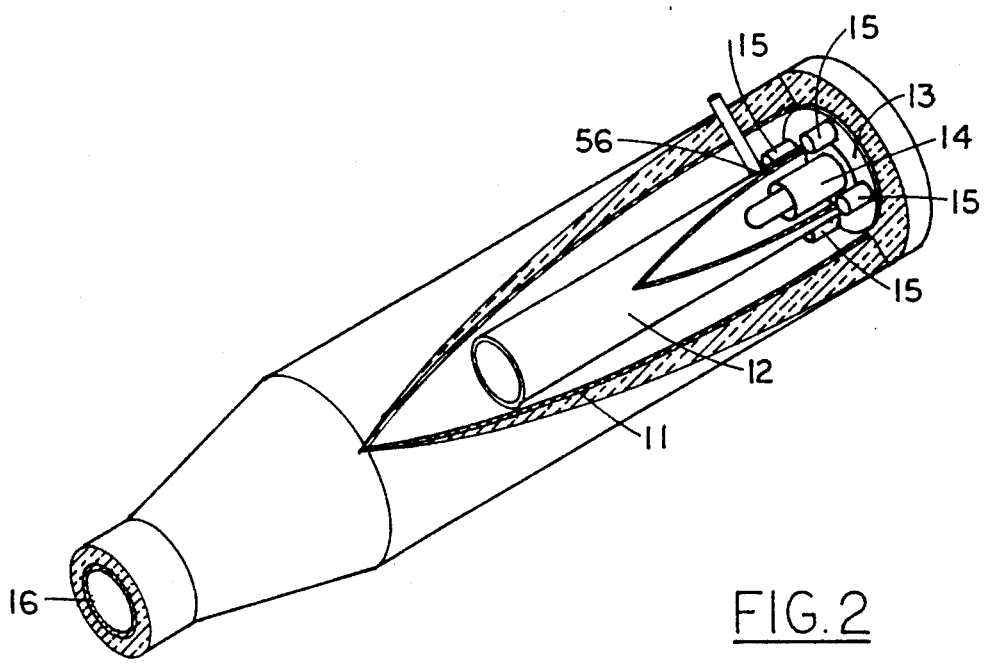
FIG. 2 is a perspective view of the combustion and evaporative components, partly broken out to show liquid mist injection means.

A suitable combustion unit 11 is seen in FIG. 2 which illustrates one form thereof. The unit 11 has an outer insulated jacket to contain the heat generated by combustion in the unit 12 during operation. The jacket wall at its base end 13 supports an array of liquid mist injectors 15 surrounding the combustor unit 12 for assuring the conversion of the mist to a vapor which collects under pressure in the unit 11 for delivery by conduit 16 to the transmission 17.

Figure 3:
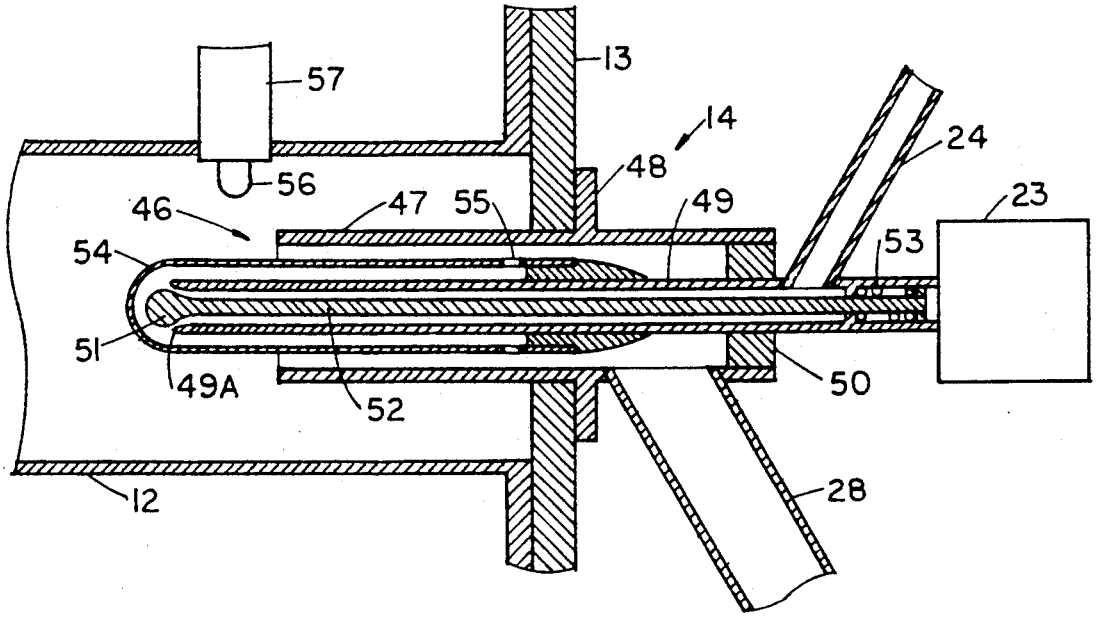
FIG. 3 is a schematic sectional view of a burner for providing the heat for vaporizing a liquid medium.

A suitable burner 14 is seen in FIG. 3 as comprising a flame tube 12 surrounding the fuel and air mixing head 46. That head 46 consists in an air passage 47 mounted in the base wall 13 by flange 48. The supply of air from the regulator 27 (See FIG. 1) is conducted by conduit 28 into the passage 47. Extending through the air passage is a fuel delivery tube 49 supported by means 50 in the outer end of the passage 47 to receive the fuel delivery conduit 24. The tube 49 supports a control valve 51 at its inner end 49A, and the valve stem 52 extends into a spring controller 53 which is part of the fuel regulator 23 previously referred to in FIG. 1. The tube 49 and its valve 51 are enclosed by a sleeve 54 which is closed at its outer end and is formed with perforations 55 at its inner end for the distribution of the fuel into the air stream moving in the passage 47. The fuel and air are mixed in the passage 47 and exit at the end of the passage in the vicinity of an igniter 56 which can be a glow plug (shown) or a spark igniter. Either of these ignition means is operatively connected by means 57 into an ignition system 58.

Figure 4:
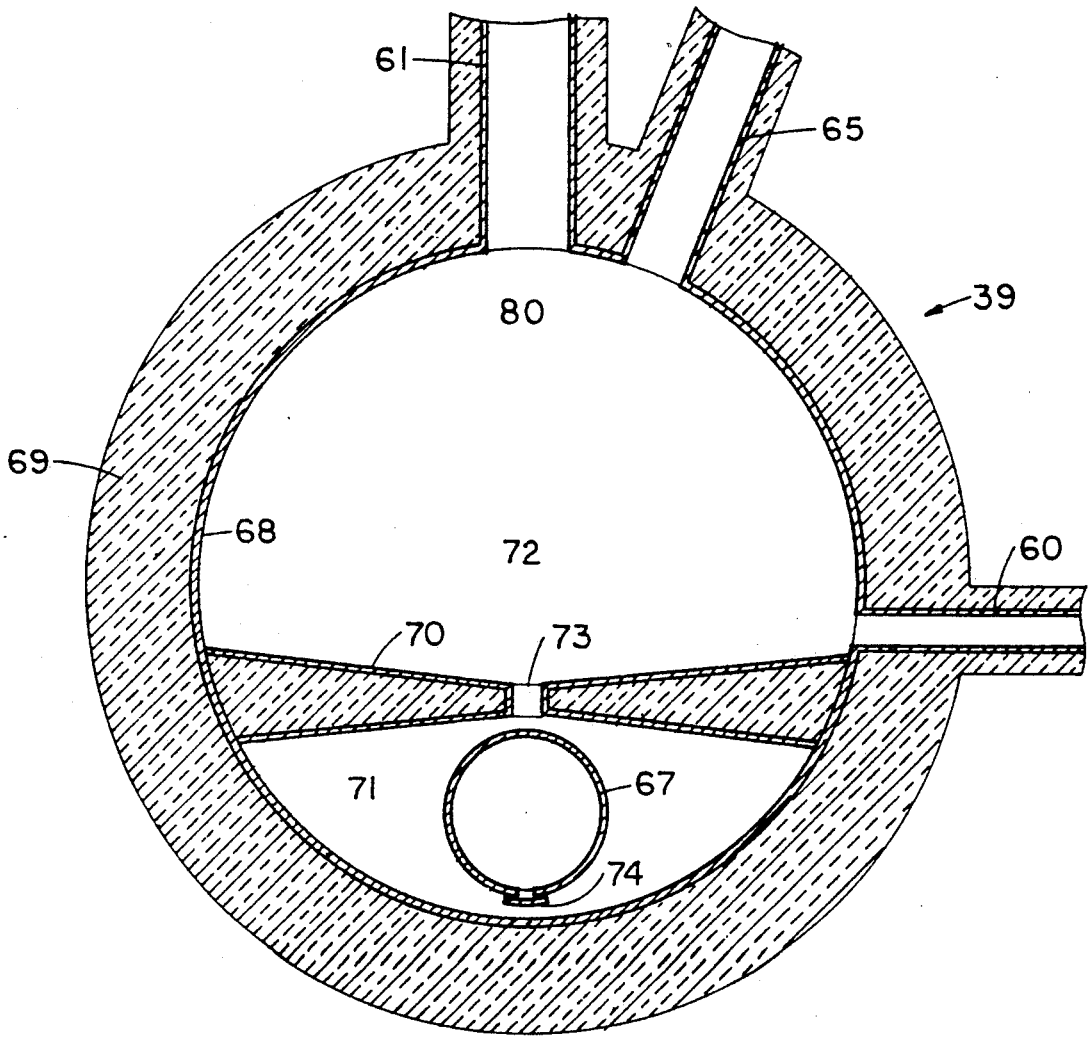
FIG. 4 is a sectional view of a component for recovery of waste vapor through condensation to a liquid, and recovery the thermal energy therein.

Turning now to FIG. 4, there is seen a sectional view of the condenser 39. The view has been taken at the right hand end of the condenser 39 to show the location of an outlet 60 connected to valve 43, and to show an outlet 61 for the accumulation of exhaust vapor under pressure in the condenser 39 above the liquid level. That outlet 61 connects through conduit 62 to the motor means 33 which operates the air pump 32. The motor means has its exhaust conduit 63 connected to a controllable regulator 64. The condenser 39 is provided with a safety vent passage 65 connected to a controllable regulator 66 for relieving the system of excessive pressure.

The exhaust vapor that reaches the condenser 39 is conveyed in the internal conduit 67 along the bottom of the condenser tank 68 which is well insulated at 69, and below an internal partition 70 which divides the interior of the tank into a liquid preheat space 71 and a liquid holding space 72. These two spaces are in communication through a series of ports 73. The vapor bubbles from the conduit 67 by way of a series of one-way outlet valves 74 into space 71, then that vapor bubbles up through ports 73 into the lower temperature pressurized liquid in the space 72 and is condensed.

Figure 5:
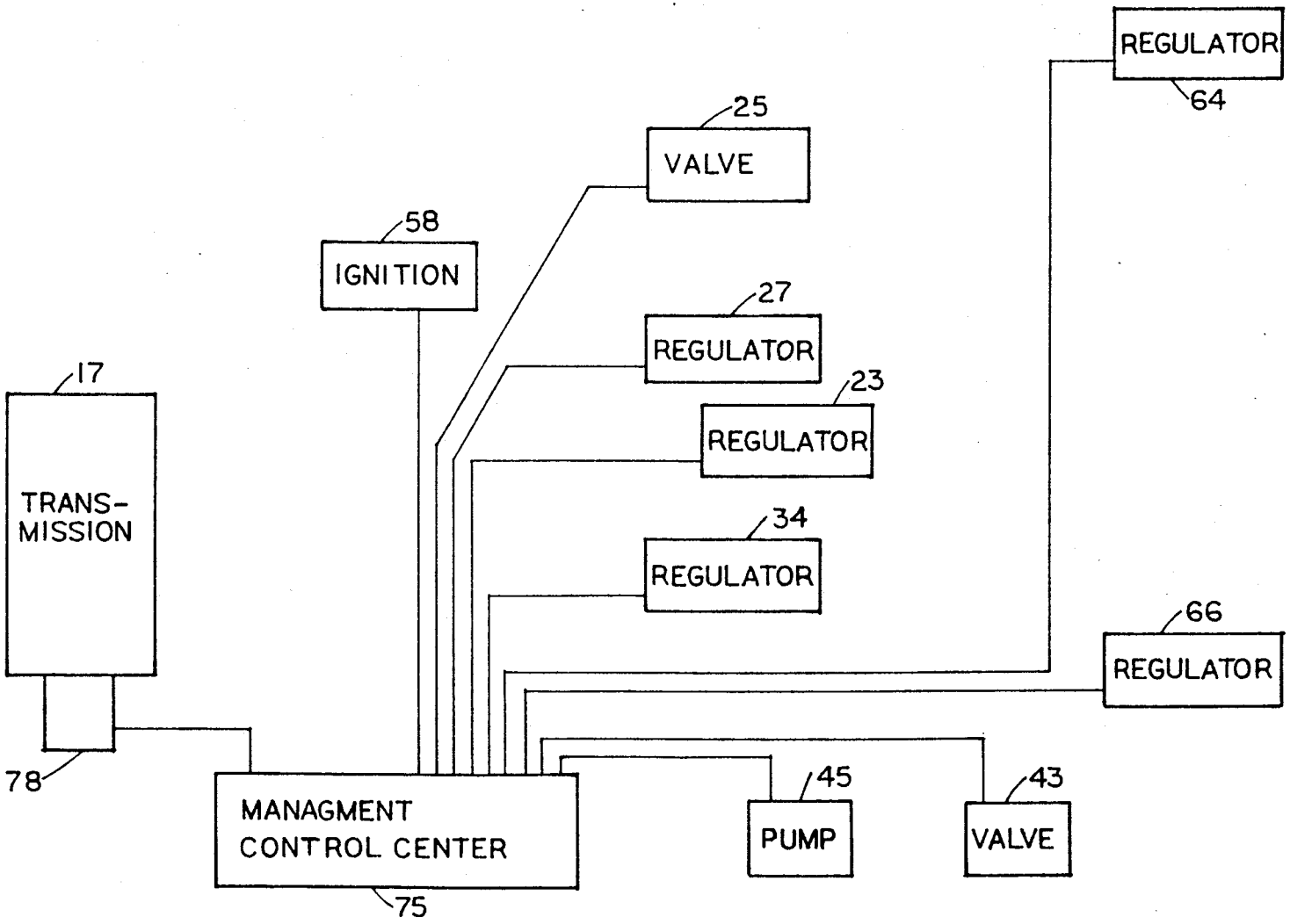
FIG. 5 is a schematic rendering of a control system for managing the system of FIG. 1.

The system shown in FIGS. 1–4 is controlled under the direction of a management control center 75 as seen in FIG. 5. The center 75 may contain a computer of known character that is connected by leads to responsive sensors in the various valves and regulators that perform the various functions to make the system operate as desired. The system of FIG. 1 must be conditioned for operation by initially pressurizing the tank 30, filling the fuel tank 21 at inlet 76 and supplying the desired quantity of liquid at inlet 77 in the condenser 39.

Initially, the control center 75 will cause the ignition means 58 to energize the glow plug 56 to bring it up to heat for initiating combustion. When the glow plug is heated up, the control center will energize the air regulator 27 and the fuel regulator 23, along with energizing the liquid regulator 34 to begin supplying liquid to the injectors 15. As the heat from the combustion builds up in the space 11, the liquid mist from the injectors will be converted to vapor which collects in the combustion means 10 at pressure and flows through conduit 16 to the transmission 17. Manual control represented by box 78 operates the transmission to effect selection of direction of rotation of the motor 18.

Once the vapor pressure has reached operating conditions, the exhaust vapor is directed by conduit 20 through the transmission 17 and eventually to heat exchanger 37 to conduit 38 to direct the vapor by conduit 67 into the bottom space 71 of the condenser 39. The vapor then bubbles up through ports 73 and is condensed under pressure into the liquid in space 72. This liquid then flows down through ports 73 to the bottom space 71 and is pumped by pump means 40 through the heat exchanger to be preheated before reaching the regulator 34 by way of conduit 36. The control 75 adjusts the regulator 34, and the regulators 27 (air) and 23 (fuel) so the combustion means 10 produces the required supply of vapor under pressure to carry the work load imposed on the motor means 18. As the exhaust vapor content accumulates in the head space 80 of the condenser 39, the pressure also builds up to a value that can be utilized rather than exhausted to atmosphere. Therefore, the contents of the head space 80 is allowed by the regulator 64 to power motor means 33 for operating the air pump 32 to supplement the supply of air in the tank 30 by setting the valve 25 to interconnect the pump and tank, as well as to continue to supply the necessary air to the regulater 27 to maintain combustion at the required level.

Should the condenser 39 reach an excessive temperature and pressure, the control will sense that condition and initiate operation of pump 45 and to activate valve 43 for moving the contents of the condenser through the radiator 44 to bring the condition into a desirable balance.

The vapor generating system embodies apparatus which includes a chamber in which the vapor energy is created by the combustion of fuel and air in a combustion space while injecting a liquid mist into the combustion space to convert the mist into a vapor at a pressure that contains sufficent energy to operate a motor 18 under the control of transmission means 17. The motor 18 is provided with an exhaust that is directed back through the transmission to be utilized in a heat exchanger 39 associated with liquid condensing means having a pump 40 to direct liquid through the heat exchanger where it is preheated on its way through suitable regulator means 34 to the liquid injection means at the combustion space. Should the heat level in the condenser means rise excessively, provision of a radiator 44 is made to dump heat to the atmosphere.

A number of pumps are provided, of which some can be air/vapor powered and some can be electric motor driven. One exception is that residual energy collected in the condenser can be recovered by employing it to drive a motor 33 for operating the air pump before releasing the remainder to atmosphere. Thus, the energy for the system remains substantailly in the system to gain an ecomony of operation of a high order.

It should now appear that the foregoing system for generating vapor under pressure and putting that vapor energy to a useful purpose is unique in its manner of generating the vapor under pressure, and utilizing the residual energy in the vapor to assist in the replacement of high pressure vapor as well as assisting in the supply of combustion supporting air. Modifications in the present system of FIG. 1 may come to mind and may constitute an equivalent system.

What is claimed is:

1. Vapor generating apparatus comprising:

(a) a chamber in which the vapor energy is created, said chamber including a combustion space, air and fuel burner means in said combustion space, and liquid injector means adjacent said combustion space to subject the injected liquid to the heat of the air and fuel combustion to convert the liquid to a supply of vapor energy;

(b) motor means responsive to vapor energy for operating therewith;

(c) transmission means connected to said chamber and to said motor means for supplying vapor energy to said motor means and for receiving back residual vapor energy exhausted by said motor means;

(d) condenser means having first means connective with said transmission means for receiving the vapor energy exhausted by said motor means and reducing the latter vapor energy to a liquid injector means to supply condensate liquid thereto;

(e) air pump means operable for supplying air under pressure to said burner means;

(f) motor means connected to said air pump means and a connection is made between said condenser means and said air pump motor means for supplying vapor energy received in said condenser means to operate said air pump motor; and (g) fuel pump means operable for supplying a fuel to said burner means.

2. The vapor energy generating apparatus set forth in claim 1 wherein heat exchange means has first means connecting between said transmission means and said condenser means to effect transfer of vapor energy therebetween and said heat exchange means has second means connecting between said condenser means and said liquid injector means in position to effect transfer of liquid condensate therebetween, said first and second means are positioned in heat exchange relationship to apply the heat of the vapor energy exhausted by said motor means to preheat the liquid condensate for said liquid injector means.

* * * * *